US006729851B2

(12) United States Patent
Cho

(10) Patent No.: US 6,729,851 B2
(45) Date of Patent: May 4, 2004

(54) VACUUM GENERATING DEVICE

(75) Inventor: Ho-Young Cho, Seoul (KR)

(73) Assignee: Korea Pneumatic System Co., Ltd.

( * ) Notice: Subject to any disclaimer, the term of this patent is extended or adjusted under 35 U.S.C. 154(b) by 0 days.

(21) Appl. No.: 10/284,224

(22) Filed: Oct. 30, 2002

(65) Prior Publication Data

US 2003/0082057 A1 May 1, 2003

(30) Foreign Application Priority Data

Nov. 1, 2001 (KR) ..... 2001-67756

(51) Int. Cl.[7] ..... F04F 5/48

(52) U.S. Cl. ..... 417/182; 417/187; 417/151; 294/64.1

(58) Field of Search ..... 417/182, 185, 417/187–189, 198, 151, 162; 248/205.8, 205.9, 362, 363; 294/64.1, 64.2

(56) References Cited

U.S. PATENT DOCUMENTS

| | | | | |
|---|---|---|---|---|
| 3,841,431 A | 10/1974 | Russey | ..... | 184/7 |
| 4,402,651 A | 9/1983 | Ise | ..... | 417/182 |
| 4,600,363 A | 7/1986 | Ise et al. | ..... | 417/187 |
| 4,655,692 A | 4/1987 | Ise | ..... | 417/187 |
| 4,861,232 A | 8/1989 | Ise et al. | ..... | 417/76 |
| 4,865,521 A | 9/1989 | Ise et al. | ..... | 417/187 |
| 4,960,364 A * | 10/1990 | Tell | ..... | 417/174 |
| 6,416,295 B1 * | 7/2002 | Nagai et al. | ..... | 417/190 |

OTHER PUBLICATIONS

Catalogue of IIAB of Sweden, "Vacuum Technique 96–35", pp. 2:16–2:23.

* cited by examiner

*Primary Examiner*—Justine R. Yu
*Assistant Examiner*—Han L Liu
(74) *Attorney, Agent, or Firm*—Piper Rudnick LLP

(57) ABSTRACT

A vacuum generating device, fabricated in the form of an ejector pump stack and used for generating negative pressure in an absorption unit, such as an absorption pad of a vacuum feeding system, is disclosed. The vacuum generating device includes a plurality of ejector pump modules that share the same shape and construction and are closely arranged in a casing to be stacked side by side while being brought into contact with each other. The casing holds the ejector pump modules in place inside the vacuum generating device. A vacuum-off unit, used for releasing vacuum pressure from vacuum chambers of the ejector pump modules, is mounted onto the casing. The vacuum generating device also includes a vacuum-on solenoid valve connected to a first air inlet port of the casing, and a vacuum-off solenoid valve connected to a second air inlet port of the vacuum-off unit. The single vacuum-on solenoid valve performs the vacuum-on operation for the ejector pump modules, and the single vacuum-off solenoid valve performs the vacuum-off operation for the ejector pump modules. The vacuum generating device thus has a very simple construction.

9 Claims, 7 Drawing Sheets

VACUUM GENERATING DEVICE

BACKGROUND OF THE INVENTION

1. Field of the Invention

The present invention relates, in general, to a vacuum generating device used for generating negative pressure in an absorption unit, such as an absorption pad, of a vacuum system, such as a vacuum feeding system used on a production line, and, more particularly, to a vacuum generating device fabricated in the form of a so-called "ejector pump stack".

2. Description of the Prior Art

An ejector pump stack-type vacuum generating device is a machine that is fabricated by closely arranging a plurality of ejector pump modules having the same shape and construction side by side, and by fixing such arranged ejector pump modules in a casing frame. In such a vacuum generating device of the ejector pump stack type, each of the ejector pump modules is connected to an absorption unit so as to generate negative pressure in the absorption unit. Such an ejector pump stack-type vacuum generating device has been preferably used in a vacuum feeding system to feed a heavy material from one place to another. When one or more absorption units, connected to the ejector pump modules of an ejector pump stack-type vacuum generating device used in a vacuum feeding system, unexpectedly fail to maintain pressure, the remaining normally functioning absorption units steadily maintain their negative pressure to safely hold a target heavy material and feed the material to a desired place.

However, conventional vacuum generating devices of the ejector pump stack type have a complex construction, so that they are expensive and are difficult to use. For example, U.S. Pat. No. 4,861,232 discloses a vacuum generating device that is fabricated in the form of an ejector pump stack. In the US vacuum generating device, a plurality of ejector pump modules, each having a vacuum-on solenoid valve and a vacuum-off solenoid valve on both sides thereof, are sequentially stacked along a fitting rail by securing the fitting bases provided at the bottoms of the pump modules onto the fitting rail, thus forming an ejector pump stack. However, the above-mentioned US device is problematic in that it requires a vacuum-on solenoid valve and a vacuum-off solenoid valve on both sides of each ejector pump module, so that the device has a complex construction, resulting in an increase in the production cost of the device.

Another example of conventional vacuum generating devices fabricated in the form of an ejector pump stack is referred to in a catalogue of PIAB of Sweden (*Vacuum Technique* 96–35, Page 2:16–2:23). The PIAB's vacuum generating device is fabricated by closely arranging a plurality of ejector pump modules side by side, and fixing the pump modules in their places inside a casing to form an ejector pump stack. In the PIAB's vacuum generating device, each ejector pump module must have a compressed air inlet port, so that it is necessary for the device to be provided with the same number of air inlet lines as that of the ejector pump modules of the pump stack, thus resulting in a complex construction of the device and being inconvenient to a user while using the device.

SUMMARY OF THE INVENTION

Accordingly, the present invention has been made keeping in mind the above problems occurring in the prior art, and an object of the present invention is to provide a vacuum generating device which is fabricated in the form of an ejector pump stack with a simple construction, and which is reliably controlled in the vacuum-on operation and vacuum-off operation of its ejector pump modules by a single vacuum-on solenoid valve and a single vacuum-off solenoid valve, thus accomplishing the desired simple construction.

In order to accomplish the above objects, the present invention provides a vacuum generating device, comprising a plurality of ejector pump modules sharing the same shape and construction, and closely arranged side by side while coming into contact with each other, each of the ejector pump modules including an air inlet chamber opened at two opposite sides thereof, a vacuum chamber opened at a single side thereof, and an air outlet chamber opened at two opposite sides thereof, with communicating means formed in each of the ejector pump modules to allow the air inlet chamber, the vacuum chamber and the air outlet chamber of the ejector pump module to communicate with each other, and a vacuum port formed on a side surface of each of the ejector pump modules so as to communicate with the vacuum chamber of the ejector pump module; a casing including a front panel brought into contact with a first of the ejector pump modules, a rear panel brought into contact with a last of the ejector pump modules, and a plurality of spacers extending between the front and rear panels to support the arranged ejector pump modules in the casing, with a first air inlet port formed on either of the front and rear panels to communicate with the air inlet chambers of the ejector pump modules, and an air outlet port formed on at least one of the front and rear panels to communicate with the air outlet chambers of the ejector pump modules; a vacuum-off unit assembled with the casing and comprising a block body including a horizontal part and a vertical part, with a plurality of guide holes formed on the horizontal part along a straight line such that the guide holes are externally connected to a plurality of absorption units and internally communicate with the vacuum ports of the ejector pump modules, respectively, a second air inlet port formed on a surface of the vertical part, a main flow path formed in the vertical part while extending from the second air inlet port, and a plurality of branch paths branching from the main flow path to respectively extend inside the vacuum-off unit to reach the guide holes; and a vacuum-on solenoid valve and a vacuum-off solenoid valve connected to the first and second air inlet ports, respectively, so as to control a flow of compressed air from a compressed air source to the first and second air inlet ports.

BRIEF DESCRIPTION OF THE DRAWINGS

The above and other objects, features and other advantages of the present invention will be more clearly understood from the following detailed description taken in conjunction with the accompanying drawings, in which:

FIGS. 3*a* and 3*b* are views of one of ejector pump modules stacked in the vacuum generating device of FIGS. 1 and 2, in which: FIG. 3*a* is a perspective view of the pump module, and FIG. 3*b* is a sectional view of the pump module;

FIG. 3*c* is an exploded view of the pump module nozzle spouts;

DETAILED DESCRIPTION OF THE INVENTION

Figure 1:
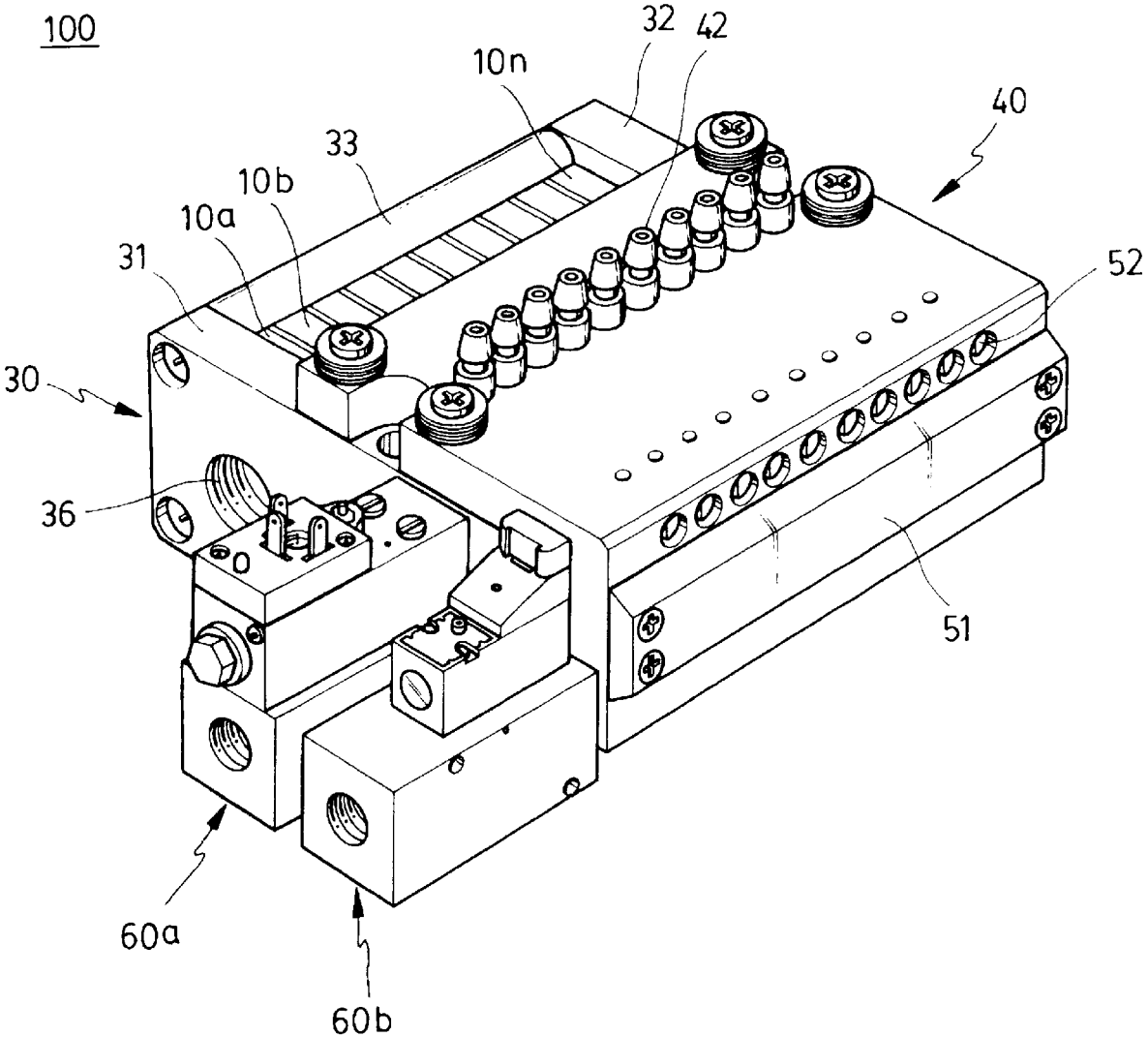
FIG. 1 is a perspective view of a vacuum generating device fabricated in the form of an elector pump stack in accordance with a preferred embodiment of the present invention.

Reference should now be made to the drawings, in which the same reference numerals are used throughout the different drawings to designate the same or similar components.

Figure 2:
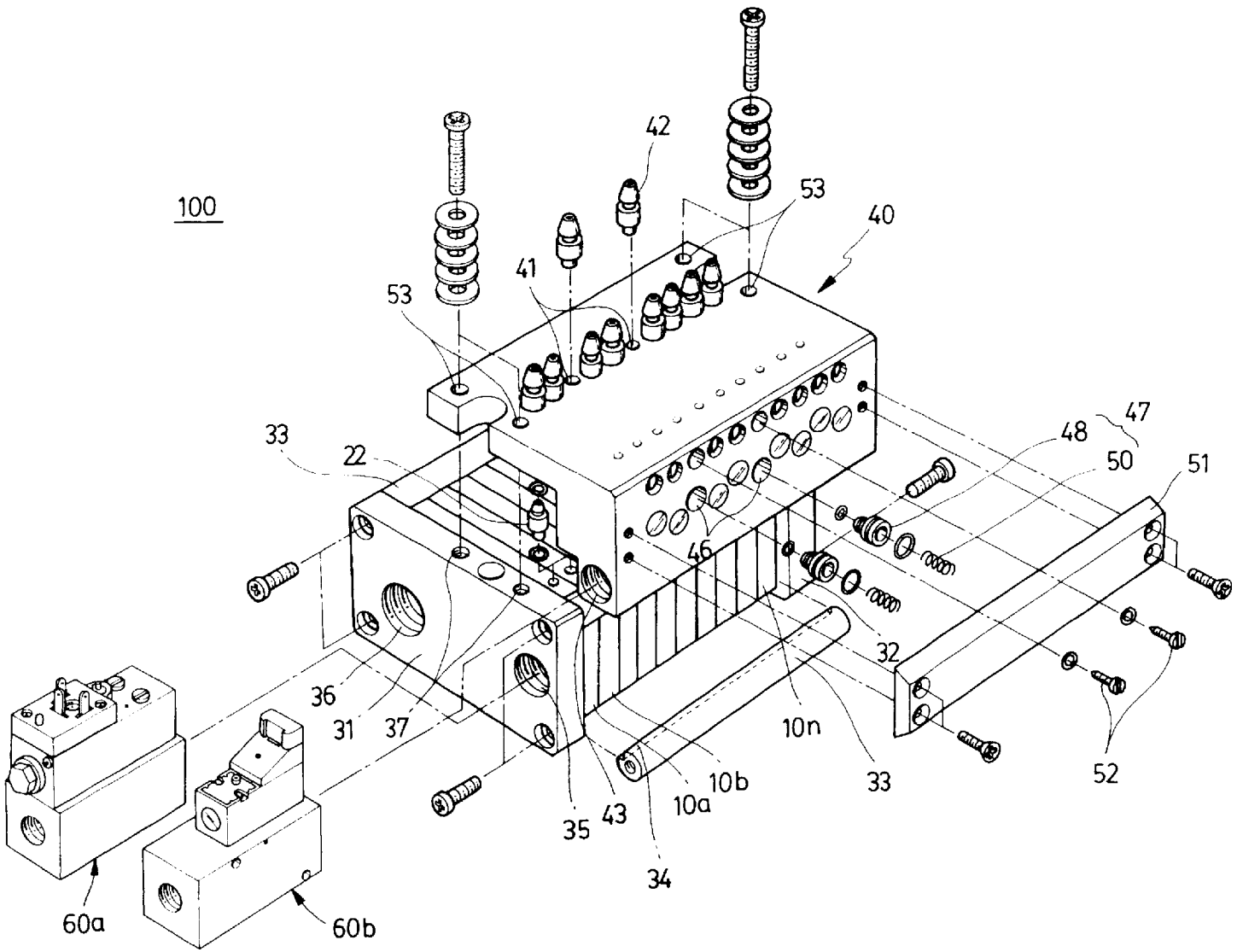
FIG. 2 is an exploded perspective view of the vacuum generating device of FIG. 1.

As shown in FIGS. 1 and 2, the vacuum generating device 100 fabricated in the form of an ejector pump stack in accordance with a preferred embodiment of the present invention comprises a plurality of ejector pump modules 10*a* to 10*n* that are closely arranged in a casing 30 to be stacked side by side while being brought into contact with each other. The casing 30 holds the ejector pump modules 10*a* to 10*n* in their places inside the vacuum generating device 100. A vacuum-off unit 40, used for releasing vacuum from vacuum chambers of the ejector pump modules 10*a* to 10*n*, is mounted onto the casing 30. The vacuum generating device 100 also comprises two solenoid valves, that is, a vacuum-on solenoid valve 60*a*, connected to the casing 30, and a vacuum-off solenoid valve 60*b*, connected to the vacuum-off unit 40.

Figure 3A:
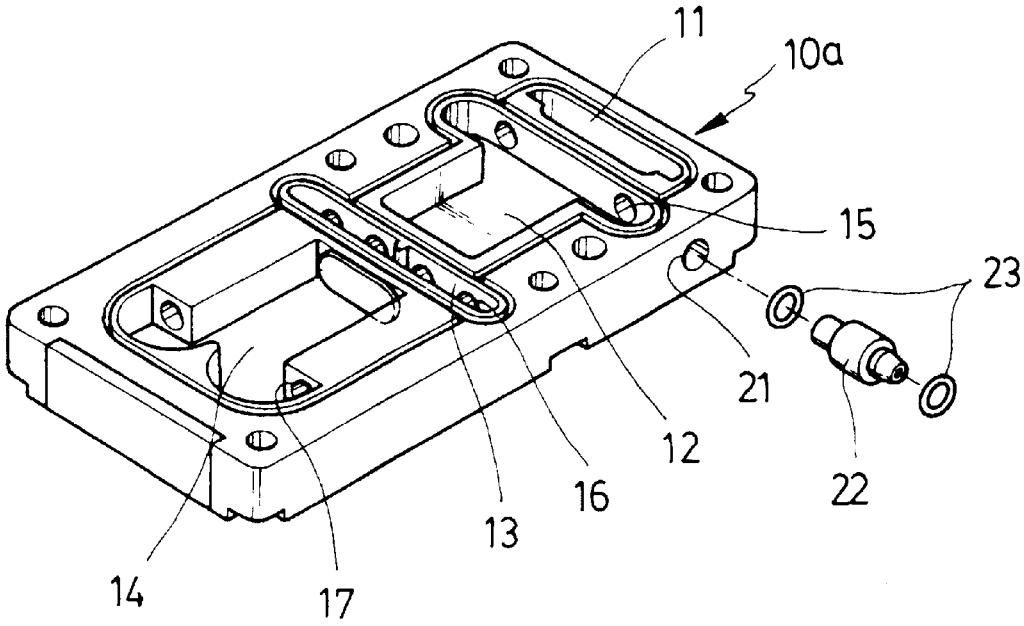
Figures 3B, 3C:
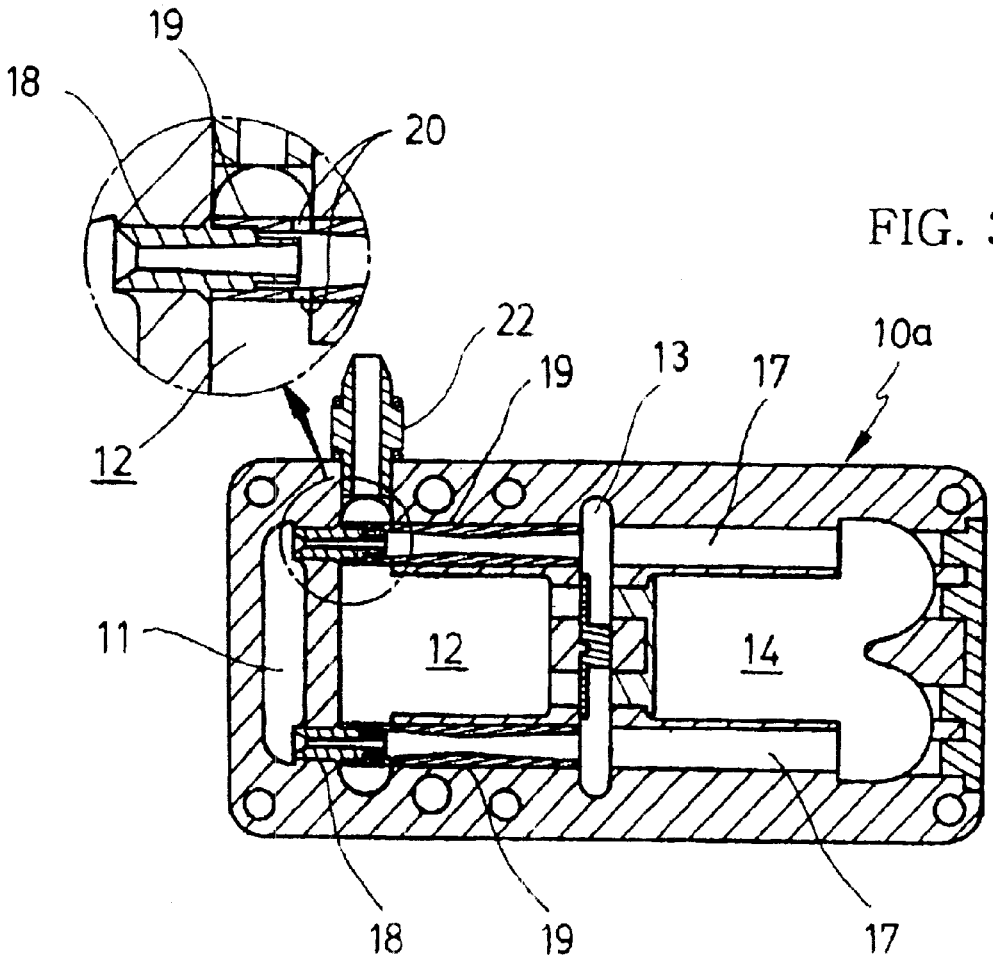

The ejector pump modules 10*a* to 10*n*, stacked in the vacuum generating device 100, share the same shape and construction. As well known to those skilled in the art, a conventional ejector pump module for such vacuum generating devices includes three functional chambers, that is, an air inlet chamber, a vacuum chamber, and an air outlet chamber, which are sequentially formed in the ejector pump module, with a plurality of serial nozzle holes formed in the ejector pump module to allow the three functional chambers to communicate with each other. The serial nozzle holes thus function as a chamber communicating means. In the vacuum generating device 100 of the present invention, the general construction of the ejector pump modules 10*a* to 10*n* remains the same as that of the conventional ejector pump module, but both the air inlet chamber and the air outlet chamber of the present pump module are opened at two opposite positions and a vacuum port is formed on a side surface of each ejector pump module of this invention such that the vacuum port communicates with the vacuum chamber. The construction of each of the ejector pump modules 10*a* to 10*n* according to the present invention is as follows. Since the ejector pump modules 10*a* to 10*n* share the same shape and construction, only the first module 10*a* is shown in FIGS. 3*a* and 3*b* and the construction of the first module 10*a* will be described with reference to the drawings. In FIGS. 3*a* and 3*b*, the reference numerals 11, 12, 13 and 14 denote an air inlet chamber, a vacuum chamber, a sub-vacuum chamber, and an air outlet chamber, respectively, and the reference numerals 15, 16 and 17 denote a plurality of serial nozzle holes formed in the ejector pump module 10*a* to allow the functional chambers 11, 12, 13 and 14 to communicate with each other. Both the air inlet chamber 11 and the air outlet chamber 14 are opened at two opposite sides thereof, while the vacuum chamber 12 is opened at a single side thereof. In the ejector pump module 10*a*, two nozzle spouts 18 and 19 are set in the nozzle holes 15 and 16, respectively, such that the nozzle spouts 18 and 19 are coupled to each other in the vacuum chamber 12, with a hole 20 formed in a sidewall of the nozzle spout 19 at a position around a coupled junction of the two nozzle spouts 18 and 19.

The reference numeral 21 denotes a vacuum port that is formed on a side surface of the ejector pump module 10*a* such that the vacuum port 21 communicates with the vacuum chamber 12. The vacuum port 21 communicates with an absorption unit (not shown) through a guide hole 41 of the vacuum-off unit 40. A first tubular connector 22 connects the vacuum port 21 of the pump module 10*a* to the guide hole 41 of the vacuum-off unit 40, with an O-ring 23 being fitted over the tubular connector 22 at a junction between the tubular connector 22 and each of the vacuum port 21 and the guide hole 41 to prevent leakage of air from the device through the junction.

When the ejector pump modules 10*a* to 10*n* are closely stacked in the casing 30 of the vacuum generating device 100, the air inlet chamber 11 and the air outlet chamber 14 of each ejector pump module communicate with the air inlet chambers 11 and the air outlet chambers 14 of neighboring pump modules, respectively. However, the vacuum chambers 12 of the ejector pump modules 10*a* to 10*n* do not communicate with each other, so that each of the ejector pump modules 10*a* to 10*n* independently generates vacuum pressure in an associated absorption unit.

The casing 30 comprises a front panel 31, a rear panel 32, and a plurality of spacers 33 extending between the front and rear panels 31 and 32 at corners of the casing 30 to maintain the spaced configuration of the casing 30 and support the stacked ejector pump modules in the casing 30. When the ejector pump modules 10*a* and 10*n* are closely stacked in the casing 30, the first module 10*a* is in close contact with the front panel 31 and the last module 10*n* is in close contact with the rear panel 32. The spacers 33 comprise four longitudinal rods each having a circular cross-section, with a longitudinal groove 34 having a V-shaped cross-section and being linearly formed along the external surface of each rod-shaped spacer 33 in an axial direction. In the casing 30, the ejector pump modules 10*a* to 10*n* are each supported at four corners thereof by the grooves 34 of the four rod-shaped spacers 33.

The front panel 31 of the casing 30 includes a first air inlet port 35 communicating with the air inlet chambers 11 of the pump modules 10*a* to 10*n*, and an air outlet port 36 communicating with the air outlet chambers 14 of the pump modules 10*a* to 10*n*. The first air inlet port 35 is connected to the vacuum-on solenoid valve 60*a* which is a normally closed-type solenoid valve. Therefore, compressed air does not flow into the first air inlet port 35 during a normal state of the vacuum-on solenoid valve 60*a*.

In the present invention, the first air inlet port 35 may be formed at the rear panel 32 without affecting the functioning of the present invention. In the same manner, the air outlet port 36 may be formed at the rear panel 32. As a further alternative, the air outlet port 36 may be formed at each of the front and rear panels 31 and 32. A plurality of internally threaded holes 37 are formed on an upper surface of each of the front and rear panels 31 and 32 at predetermined positions so as to secure the vacuum-off unit 40 to the casing 30 using a plurality of setscrews.

The vacuum-off unit 40 comprises a right-angled block body including a horizontal part and a vertical part. A plurality of guide holes 41 are formed on the horizontal part of the vacuum-off unit 40, such that the guide holes 41 are arranged along a straight line and respectively communicate with the vacuum ports 21 of the ejector pump modules 10*a* to 10*n*. A second tubular connector 42 is inserted into the outer end of each of the guide holes 41 of the vacuum-off unit 40, such that the connecting hose (not shown) of an associated absorption unit is easily and airtightly connected to the guide hole 41. A second air inlet port 43 is formed on an end surface of the vertical part of the vacuum-off unit 40, and is connected to the vacuum-off solenoid valve 60*b* which is a normally closed-type solenoid valve. Therefore, compressed air does not flow into the second air inlet port 43 during a normal state of the vacuum-off solenoid valve 60*b*.

Figure 4:
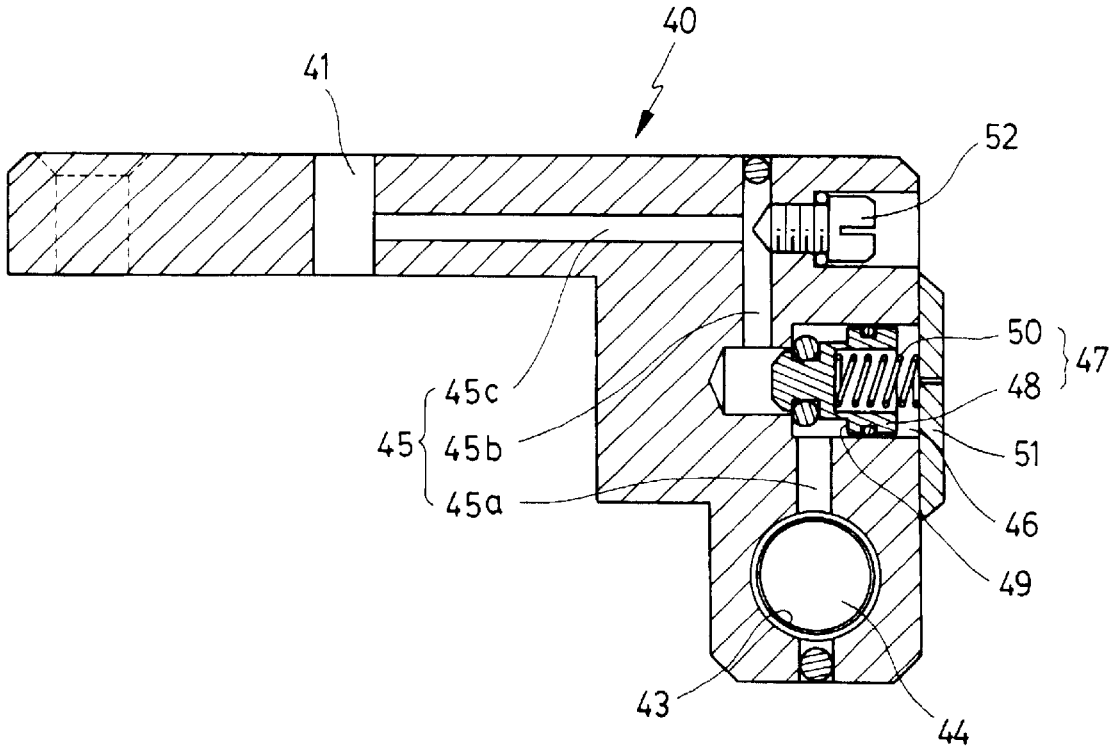
FIG. 4 is a sectional view of a vacuum-off unit used for releasing vacuum from vacuum chambers of the pump modules stacked in the vacuum generating device of FIGS. 1 and 2.

As shown in FIG. 4, a main flow path 44 is formed in the vertical part of the vacuum-off unit 40. The main flow path 44 extends inward from the second air inlet port 43 to a predetermined length, with a plurality of branch paths 45 branching from the main flow path 44 to respectively reach the guide holes 41. In order to control the branch paths 45, a plurality of valve-seating holes 46 are formed on the vertical part of the vacuum-off unit 40 such that the valve-seating holes 46 respectively extend to the branch paths 45, with an air valve 47 being set in each of the valve-seating holes 46 such that the air valve 47 is operated in response to pressure from compressed air supplied thereto through the second air inlet port 43, thus controlling an associated branch path 45. The air valves 47, set in the valve-seating holes 46, prevent atmospheric air from flowing into the ejector pump modules 10*a* to 10*n* through the vacuum-off unit 40 during the vacuum-on operation of the device 100. Of course, since the vacuum-off solenoid valve 60*b* primarily prevents such an undesired introduction of atmospheric air into the ejector pump modules 10*a* to 10*n*, the air valves 47 function to subsidiarily prevent the undesired introduction of atmospheric air into the ejector pump modules 10*a* to 10*n*.

In a detailed description, each of the branch paths 45 comprises a first path 45*a* that extends upward from the main flow path 44 in a vertical direction, a second path 45*b* that extends upward in the vacuum-off unit 40 along a vertical axis which is eccentric from that of the first path 45*a*, and a third path 45*c* that perpendicularly extends from the upper end of the second path 45*b* to an associated guide hole 41. The first paths 45*a* respectively communicate with the second paths 45*b* through the valve-seating holes 46 which are formed in the vertical part of the vacuum-off unit 40, with the air valves 47 set in the valve-seating holes 46 to control the communication of the second paths 45*b* with the first paths 45*a*.

Figure 5:
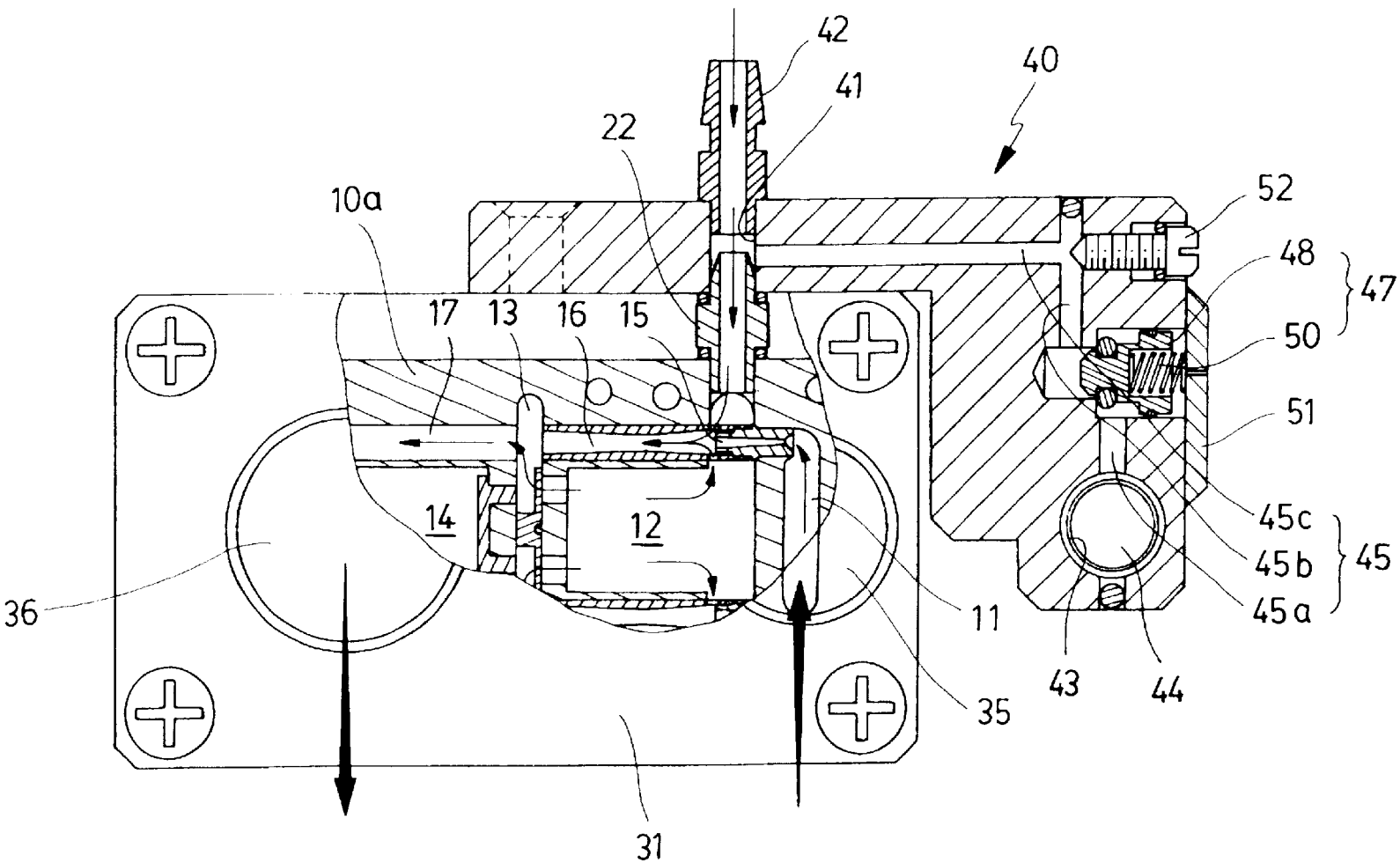
FIG. 5 is a partially sectioned view of the vacuum generating device of FIG. 1, showing the vacuum-on operation of the device.
Figure 6:
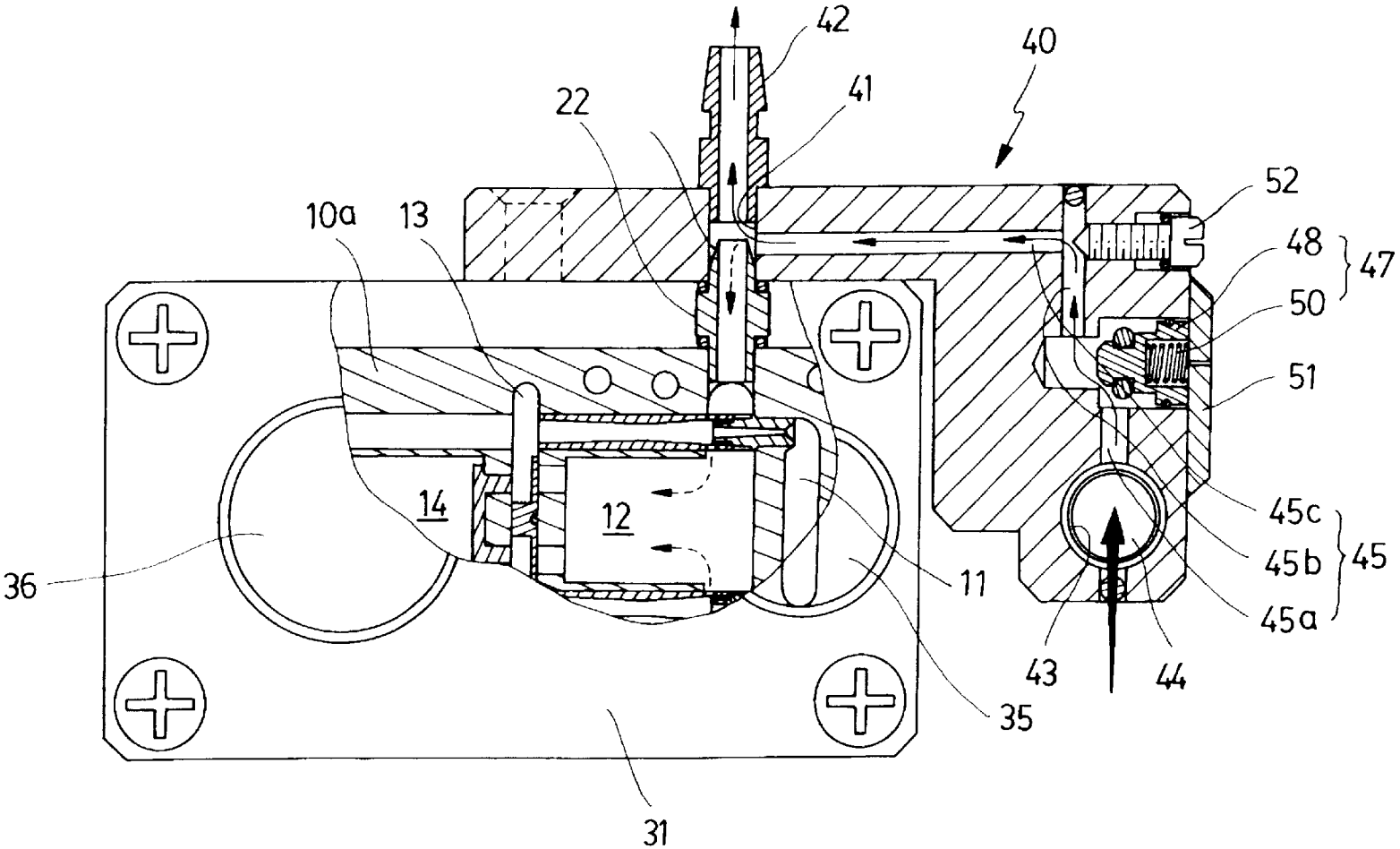
FIG. 6 is a partially sectioned view of the vacuum generating device of FIG. 1, showing the vacuum-off operation of the device.

The air valves 47, set in the valve-seating holes 46 of the vacuum-off unit 40, are designed such that they are operated in response to pressure of compressed air. Each of the air valves 47 comprises a valve body 48 having an annular step 49. Each of the valve bodies 48 is elastically biased by a spring 50 in a predetermined direction in an associated valve-seating hole 46. In the drawings, the reference numeral 51 denotes a valve cover that is externally mounted to the side surface of the vertical part of the vacuum-off unit 40 so as to hold the air valves 47 in the valve-seating holes 46 without allowing undesired removal of the valves 47 from the vacuum-off unit 40. When compressed air flows from the second air inlet port 43 into the valve-seating holes 46, with the air valves 47 each positioned to close the junction between the first and second paths 45*a* and 45*b* as shown in FIG. 5, pressure of the compressed air acts on the annular surfaces of the valve body's steps 49, so that the valve bodies 48 of the air valves 47 are pushed outward while compressing the springs 50, as shown in FIG. 6. The second paths 45*b* thus communicate with the first paths 45*a*, respectively. Of course, it should be understood that the construction of each air valve 47 may be changed from the above-mentioned construction without affecting the functioning of the present invention.

In the drawings, the reference numeral 52 denotes a plurality of control screws that are horizontally threaded inward from the side surface of the vertical part of the vacuum-of unit 40 such that the control screws 52 are aligned with the third paths 45*c*, respectively, thus allowing a user to manually adjust the opening ratios of the third paths 45*c* to control the speed of releasing vacuum from the vacuum chambers 12, as desired. In the present invention, the control screws 52 may be vertically threaded downward from the upper surface of the horizontal part of the vacuum-of unit 40 such that the control screws 52 are aligned with the second paths 45*b*, respectively. In such a case, the control screws 52 allow a user to adjust the opening ratios of the second paths 45*b* to control the speed of releasing vacuum from the vacuum chambers 12, as desired.

In order to mount the vacuum-off unit 40 to the casing 30, a plurality of through holes 53 are formed at each end of the horizontal part of the vacuum-off unit 40 at positions corresponding to the internally threaded holes 37 of the casing 30. The vacuum-off unit 40 is thus mounted to the casing 30 using the setscrews which pass through the through holes 53 prior to being screwed into the internally threaded holes 37.

In order to use the vacuum generating device 100 to feed a material from one place to another, the connecting hoses (not shown) of a plurality of absorption units, such as absorption pads of a vacuum feeding system, laid on a target material are primarily coupled to the second tubular connectors 42 of the device 100 of FIG. 1, respectively. In addition, two connecting hoses (not shown) of an external compressed air source are connected to the vacuum-on solenoid valve 60*a* and the vacuum-off solenoid valve 60*b*, respectively. The vacuum generating device 100, completely connected to the absorption units and the compressed air source as described above, is operated as follows.

When the vacuum-on solenoid valve 60*a* is turned on to perform a vacuum-on operation of the device 100, compressed air from the external compressed air source flows into the air inlet chambers 11 of the ejector pump modules 10*a* to 10*n* through the first air inlet port 35. Thereafter, the compressed air flows from the air inlet chambers 11 to the vacuum chamber 12 through the first nozzle holes 15, and flows from the vacuum chamber 12 to the sub-vacuum chamber 13 through the second nozzle holes 16. The compressed air flows from the sub-vacuum chamber 13 to the air outlet chamber 14 through the third nozzle holes 17, prior to being discharged to the outside of the device 100 through the air outlet port 36. In such a case, air remaining in the absorption units is discharged from the absorption units into the vacuum chambers 12 through the guide holes 41 and the vacuum ports 21, prior to being discharged to the outside of the device 100 along with the compressed air through the air outlet port 36, as shown in FIG. 5. Therefore, vacuum is generated in the vacuum chambers 12 of the ejector pump modules 10*a* to 10*n*, so that desired negative pressure is generated inside the absorption units, thus allowing the absorption units to hold the target material. During the vacuum-on operation of the device 100, the vacuum-off solenoid valve 60*b* which is a normally closed-type solenoid valve closes the second air inlet port 43 of the vacuum-off unit 40, and, in addition, the air valves 47 close the branch paths 45 branching the main flow path 44. Therefore, the vacuum-off unit 40 does not give any influence to the device 100 during the vacuum-on operation for generating negative pressure inside the absorption units.

In order to release the negative pressure from the absorption units, compressed air is supplied to the second air inlet port 43 of the vacuum-off unit 40. That is, when the vacuum-off solenoid valve 60*b* is turned on to perform a vacuum-off operation, compressed air from the external compressed air source flows into the main flow path 44 through the second air inlet port 43, as shown in FIG. 6. The compressed air is, thereafter, introduced from the main flow path 44 into the valve-seating holes 46 through the first paths 45*a*, so that pressure of the compressed air acts on the annular steps 49 of the valve bodies 48 of the air valves 47, thus pushing the valve bodies 48 outward while compressing the springs 50. The air valves 47 thus open the junctions of the first and second paths 45*a* and 45*b*, so that the compressed air flows through the second paths 45*b*. When the control screws 52 allow the compressed air to flow from the second paths 45*b* to the third paths 45*c*, the compressed air flows to the absorption units through the third paths 45*c* and the guide holes 41. When compressed air reaches the absorption units as described above, the existing negative pressure is instantaneously released from the absorption units, and, in addition, the existing vacuum is quickly eliminated from the vacuum chambers 12 of the ejector pump modules 10*a* to 10*d*. In such a case, it is possible to adjust the vacuum releasing speed by appropriately tightening or loosening the control screws 52 such that the opening ratios of the third paths 45*c*. When the control screws 52 are adjusted to reduce the opening ratios of the third paths 45*c*, the vacuum releasing speed is lowered.

As described above, the present invention provides a vacuum generating device, fabricated in the form of an ejector pump stack and preferably used for generating negative pressure in absorption units, such as absorption pads of a vacuum feeding system. In the vacuum generating device of the present invention, a plurality of ejector pump modules are closely stacked in a casing to form an ejector pump stack, with a single vacuum-on solenoid valve connected to the first air inlet port of the device to perform the vacuum-on operation for the ejector pump modules, and a single vacuum-off solenoid valve connected to the second air inlet port of the device to perform the vacuum-off operation for the ejector pump modules. Therefore, the construction of the vacuum generating device according to the present invention is remarkably simplified, in comparison with conventional vacuum generating device fabricated with stacked pump modules each having a vacuum-on solenoid valve and a vacuum-off solenoid valve.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A vacuum generating device, comprising:

a plurality of ejector pump modules sharing the same shape and construction, and closely arranged side by side while coming into contact with each other, each of said ejector pump modules including an air inlet chamber opened at two opposite sides thereof, a vacuum chamber opened at a single side thereof, and an air outlet chamber opened at two opposite sides thereof, with communicating means formed in each of the ejector pump modules to allow the air inlet chamber, the vacuum chamber and the air outlet chamber of the ejector pump module to communicate with each other, and a vacuum port formed on a side surface of each of the ejector pump modules so as to communicate with the vacuum chamber of the ejector pump module;

a casing including a front panel brought into contact with a first of the ejector pump modules, a rear panel brought into contact with a last of the ejector pump modules, and a plurality of spacers extending between said front and rear panels to support the arranged ejector pump modules in the casing, with a first air inlet port formed on either of the front and rear panels to communicate with the air inlet chambers of the ejector pump modules, and an air outlet port formed on at least one of the front and rear panels to communicate with the air outlet chambers of the ejector pump modules;

a vacuum-off unit assembled with said casing and comprising a block body including a horizontal part and a vertical part, with a plurality of guide holes formed on said horizontal part along a straight line such that the guide holes are externally connected to a plurality of absorption units and internally communicate with the vacuum ports of the ejector pump modules, respectively, a second air inlet port formed on a surface of said vertical part, a main flow path formed in said vertical part while extending from the second air inlet port, and a plurality of branch paths branching from said main flow path to respectively extend inside the vacuum-off unit to reach said guide holes; and a vacuum-on solenoid valve and a vacuum-off solenoid valve connected to the first and second air inlet ports, respectively, so as to control a flow of compressed air from a compressed air source to the first and second air inlet ports.

2. The vacuum generating device according to claim 1, wherein said spacers of the casing comprise four longitudinal rods each having a circular cross-section, with a longitudinal groove linearly formed along an external surface of each of the rod-shaped spacers in an axial direction so as to seat four corners of each of the ejector pump modules.

3. The vacuum generating device according to claim 1, wherein a tubular connector connects the vacuum port of each of the ejector pump modules to an associated guide hole of said vacuum-off unit.

4. The vacuum generating device according to claim 1, wherein a plurality of air valves are installed in said vacuum-off unit such that each of the air valves is operated in response to pressure of compressed air supplied thereto through the second air inlet port, thus opening an associated one of the branch paths.

5. The vacuum generating device according to claim 4, wherein each of said air valves comprises a valve body moved in response to pressure of compressed air acting thereon, and a spring functioning to elastically bias said valve body in a predetermined direction, whereby said valve body is moved by compressed air supplied thereto through the second air inlet port, thus opening an associated branch path.

6. The vacuum generating device according to claim 5, wherein each of said branch paths of the vacuum-off unit comprises a first path extending from said main flow path in a vertical direction, a second path extending in said vacuum-off unit along a vertical axis which is eccentric from a vertical axis of said first path, and a third path perpendicularly extending from said second path to an associated guide hole, said first and second paths communicating with each other through a valve-seating hole formed inward from a surface of the vertical part of said vacuum-off unit, with an associated air valve set in the valve-seating hole.

7. The vacuum generating device according to claim 4, wherein each of said branch paths of the vacuum-off unit comprises a first path extending from said main flow path in a vertical direction, a second path extending in said vacuum-off unit along a vertical axis which is eccentric from a vertical axis of said first path, and a third path perpendicularly extending from said second path to an associated guide hole, said first and second paths communicating with each other through a valve-seating hole formed inward from a surface of the vertical part of said vacuum-off unit, with an associated air valve set in the valve-seating hole.

8. The vacuum generating device according to claim 4, wherein a plurality of control screws are installed in said vacuum-off unit to allow manual adjustment of opening ratios of the branch paths.

9. The vacuum generating device according to claim 1, wherein a plurality of control screws are installed in said vacuum-off unit to allow manual adjustment of opening ratios of the branch paths.

* * * * *